US010173093B2

(12) United States Patent
Shi

(10) Patent No.: US 10,173,093 B2
(45) Date of Patent: Jan. 8, 2019

(54) MULTIFUNCTIONAL MUSCLE EXERCISER

(71) Applicant: Qiang Shi, Hangzhou (CN)

(72) Inventor: Qiang Shi, Hangzhou (CN)

( * ) Notice: Subject to any disclaimer, the term of this patent is extended or adjusted under 35 U.S.C. 154(b) by 25 days.

(21) Appl. No.: 15/594,571

(22) Filed: May 13, 2017

(65) Prior Publication Data

US 2017/0246494 A1 Aug. 31, 2017

Related U.S. Application Data

(63) Continuation of application No. PCT/CN2015/093766, filed on Nov. 4, 2015.

(30) Foreign Application Priority Data

Dec. 2, 2014 (CN) ..... 2014 1 0720505

(51) Int. Cl.

| | |
|---|---|
| ***A63B 21/00*** | (2006.01) |
| ***A63B 21/02*** | (2006.01) |
| ***A63B 21/045*** | (2006.01) |
| ***A63B 23/02*** | (2006.01) |
| ***A63B 23/035*** | (2006.01) |
| ***A63B 23/12*** | (2006.01) |
| ***A63B 71/00*** | (2006.01) |

(52) U.S. Cl.

CPC ..... *A63B 21/023* (2013.01); *A63B 21/026* (2013.01); *A63B 21/045* (2013.01); *A63B 21/4035* (2015.10); *A63B 21/4047* (2015.10); *A63B 23/0233* (2013.01); *A63B 23/03533* (2013.01); *A63B 23/12* (2013.01); *A63B 23/1209* (2013.01); *A63B 2071/0072* (2013.01); *A63B 2225/09* (2013.01)

(58) Field of Classification Search

CPC . A63B 21/025; A63B 21/0442; A63B 21/045; A63B 21/0455; A63B 21/0407; A63B 21/0414; A63B 21/0435; A63B 23/03533; A63B 23/0355

See application file for complete search history.

(56) References Cited

U.S. PATENT DOCUMENTS 6,106,438 A 8/2000 Dean

FOREIGN PATENT DOCUMENTS

| | | |
|---|---|---|
| CN | 202078690 U | 12/2011 |
| CN | 202777581 U | 3/2013 |
| CN | 104107530 A | 10/2014 |

(Continued)

OTHER PUBLICATIONS

Machine Translation of DE20002268, Espacenet.*
Machine Translation of CN202078690, Espacenet.*

*Primary Examiner* — Jennifer M Deichl
(74) *Attorney, Agent, or Firm* — Wayne & King LLC

(57) ABSTRACT

Disclosed is a multifunctional muscle exerciser comprising two handles (1, 2). The two handles (1, 2) each comprise a connection end (1*a*, 2*a*) and a grip end (1*b*, 2*b*). A torsional spring (3) is connected between the connection ends (1*a*, 2*a*) of the two handles (1, 2). The torsional spring (3) is composed of stacked multichip spring steel pieces (31). The two ends of the multichip spring steel pieces (31) are respectively connected via fasteners. Preferably, both of the two handles (1, 2) are U-shaped. The connection ends (1*a*, 2*a*) of the two handles (1, 2) are coaxially arranged. The grip ends (1*b*, 2*b*) of the two handles (1, 2) are in parallel but are not on the same straight line.

8 Claims, 37 Drawing Sheets

(56) References Cited

FOREIGN PATENT DOCUMENTS

| | | | |
|---|---|---|---|
| CN | 104492027 | A | 4/2015 |
| CN | 204261256 | U | 4/2015 |
| DE | 20002268 | U1 | 4/2000 |

* cited by examiner

MULTIFUNCTIONAL MUSCLE EXERCISER

CROSS-REFERENCE TO RELATED APPLICATIONS

This application is a continuation of International Patent Application No. PCT/CN2015/093766 with a filing date of Nov. 4, 2015, designating the United States, now pending, and further claims priority to Chinese Patent Application No. 201410720505.5 with a filing date of Dec. 2, 2014, designating the United States, now pending. The content of the aforementioned applications, including any intervening amendments thereto, are incorporated herein by reference.

TECHNICAL FIELD

The present invention relates to fitness equipment, in particular to a multifunctional muscle exerciser which is mainly used for exercising muscles of arms, chest and shoulders.

BACKGROUND OF THE PRESENT INVENTION

At present, a wide variety of fitness equipment for exercising muscles is present on the market, but basically can be classified into two categories, in which one uses the weight of an instrument to provide resistance; and the other uses a spring to provide the resistance. The existing arm exercisers using the springs to provide the resistance all adopt ordinary steel wire coil springs; due to limit of spring indexes (wire-diameter ratios) of the coil springs, when relatively great resistance needs to be provided, volumes of the coil springs may become relatively large, causing that the fitness equipment is relatively large in volume or relatively heavy in weight, thereby not only increasing manufacturing cost, but also resulting in inconvenience in storage and carrying.

In addition, most of the existing arm exercisers have a single function and is hard to achieve an effect of comprehensive exercise. Some arm exercisers having multiple functions often are manufactured by simply combining several different instruments, resulting in not only use inconvenience, but also reliability reduction.

For example, the China utility model patent CN203663337U discloses a multifunctional arm exerciser which can be used as an arm exerciser for exercising arm strength and can also be used as a chest expander for exercising chest muscles. The multifunctional arm exerciser comprises grip handles and first springs; sleeves with external threads are respectively fixed at both ends of the first springs; the grip handles arranged on the left and right are detachably arranged at both ends of the first springs for bearing bending moment through the threads, respectively, and constitute the arm exerciser; several annular first connection rings with buckle structures are respectively arranged on the two handles in a length direction; after removing the first springs from the two grip handles, a plurality of second springs sleeved inside the first springs are drawn out, and both ends of the second springs are connected with the opposite first connection rings on the two grip handles through annular second connection rings, so that the two grip handles and the second springs constitute the chest expander. In the patent, the coil springs are used as resistance elements, so large volume, security risk and other shortcomings also exist. In addition, when the multifunctional arm exerciser changes functions, the springs need to be disassembled and assembled again, causing use inconvenience.

For another example, the China utility model patent CN203220727U discloses a multifunctional arm exerciser which comprises an intermediate section spring, handles on both sides, and a protection rope; coiled opening-angle springs are connected to top ends of the handles on both sides; the other end of the coiled opening-angle springs are connected with handles of a grip exerciser; and the multifunctional arm exerciser can be used as an arm exerciser for exercising arm strength, and can also be used as the grip exerciser composed of the handle at one end, the spring and the handles, for exercising grip strength. Although the protection rope is arranged for improving security in the patent, other defects brought by the coiled springs still cannot be overcome. Moreover, the arm exerciser may also cause use inconvenience in such a manner that the grip exerciser is added on the handles.

SUMMARY OF PRESENT INVENTION

A technical problem to be solved by the present invention is to provide a multifunctional muscle exerciser which is small in volume, large in torsional force and good in security.

In order to solve the above technical problem, the present invention adopts the following technical solution: the multifunctional muscle exerciser comprises two handles; the two handles each comprise a connection end and a grip end; a torsional spring is connected between the connection ends of the two handles; the torsional spring is composed of a plurality of stacked spring steel pieces; and both ends of the plurality of spring steel pieces are respectively connected via fasteners.

Preferably, the handles are molded by engineering plastics.

Preferably, the connection ends of the two handles are provided with notches; and end parts of the spring steel pieces are clamped in the notches and are fixedly connected to the connection ends of the two handles via the fasteners.

Further, the handles are made of pipes having inner holes; a spring fixing base is fixed in each of the inner holes of the two handles; and the notch is disposed in the spring fixing base.

Preferably, the two handles are U-shaped; connection ends of the two handles are coaxially arranged; and the grip ends of the two handles are arranged side by side.

More preferably, one end of the torsional spring is fixedly connected with the connection end of one handle, and the other end is fixedly connected with a spring clamping base; a spline sleeve is fixedly arranged at the connection end of the other handle; a section of spline shaft is arranged on the spring clamping base; and the spline shaft is matched with the spline sleeve.

Compared with the existing art, the present invention has the following beneficial effects:

(1) In the present invention, the torsional spring composed of a plurality of spring steel pieces is adopted, and has advantages of small size, light weight and convenient fixation of both ends.

(2) The torsional spring has large elastic force.

(3) Two U-shaped handles are adopted; as long as an angle between the two handles is set reasonably or a distance between the grip ends of the two handles is set reasonably, the multifunctional muscle exerciser can be both clamped and stretched. When the angle between the two handles is reduced, the multifunctional muscle exerciser can be used as a chest expander; and when the angle between the two handles is increased, the multifunctional muscle exerciser can be used as a "press device" or a grip exerciser.

(4) A structure for matching the spline shaft with the spline sleeve is adopted, so that the angle between the two handles is adjustable; not only functions of the multifunctional muscle exerciser and the grip exerciser can be easily realized, but also the torsional force can be easily adjusted, so as to realize a variety of exercise forms for exercising different muscle groups.

(5) The whole instrument is relatively light in weight, comfortable and secure in use, foldable and portable.

A LIST OF REFERENCE NUMERALS

1. left handle; 1*a*. connection end; 1*b*. grip end; 1*c*. convex rib; 2. right handle; 2*a*. connection end; 2*b*. grip end; 3. torsional spring; 31. spring steel piece; 3*a*. through hole; 32. spring fixing base; 32*a*. notch; 32*b*. through hole; 32*c*. groove; 32*d*. fixing hole; 33. spring clamping base; 33*a*. notch; 33*b*. spline shaft; 33*c*. guide shaft; 33*d*, annular groove; 34. spline sleeve; 34*a*. spring; 34*b*. jacking bead; 4. sleeve; 41. baffle ring; 5. liner pipe; 6. outer gear ring;

61. convex tooth; 61*a*. special convex tooth; 62. tooth groove;

62*a*. special tooth groove; 7. inner gear ring; 71. tooth groove;

71*a*. special tooth groove; 72. convex tooth; and 72*a*. special convex tooth.

DETAILED DESCRIPTION OF PREFERRED EMBODIMENTS

Specific embodiments of the present invention are further described in detail below in combination with drawings. These embodiments are merely used for illustrating the present invention, rather than limiting the present invention.

In description of the present invention, it should be noted that a directional or positional relationship indicated by terms such as "left", "right", "inner" and "outer" is the directional or positional relationship shown based on the drawings, and is merely used for facilitating the description of the present invention and simplifying the description, rather than indicating or implying that referred apparatuses or elements must have a particular direction and must be constructed and operated in a particular direction, so as not to be construed as a limitation to the present invention.

In addition, in the description of the present invention, unless otherwise stated, "a plurality of" means two or more.

Embodiment 1

Figure 1:
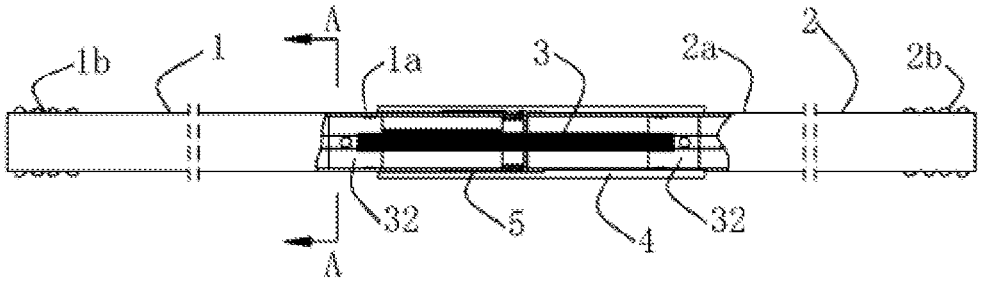
FIG. 1 is a structural schematic diagram of Embodiment 1 of a multifunctional muscle exerciser according to the present invention.

As shown in FIG. 1, a multifunctional muscle exerciser of the present invention comprises left and right handles 1 and 2; two handles 1 and 2 each comprise a connection end 1*a*, 2*a* and a grip end 1*b*, 2*b*; the handles 1 and 2 in the present embodiment are made of metal pipes having inner holes, e.g., made of steel pipes or aluminum alloy pipes, wherein a torsional spring 3 is connected between the connection ends 1*a* and 2*a* of the two handles; and the torsional spring 3 can provide torsional resistance when the grip ends 1*b* and 2*b* of the two handles are gripped by both hands and are rotated in opposite directions, so as to exercise torsional force of both arms.

Figure 2:
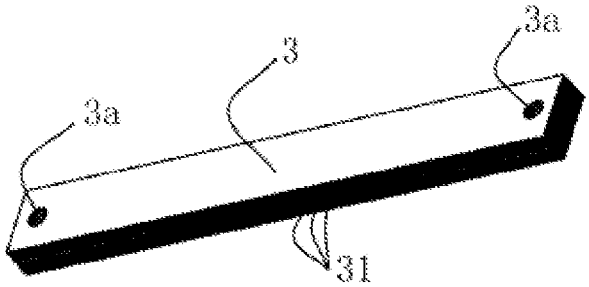
FIG. 2 is a structural schematic diagram of a torsional spring according to the present invention.

As shown in FIG. 2, the torsional spring 3 of the present invention is formed by stacking a plurality of spring steel pieces 31 up and down; both ends of the spring steel pieces 31 are provided with through holes 3*a*; and the spring steel pieces can be connected together through rivets, bolts or other fasteners. When torque is applied to both ends of the torsional spring 3 through the handles, the torsional spring 3 can provide relatively large elastic force and is small in volume and light in weight.

Figure 3:
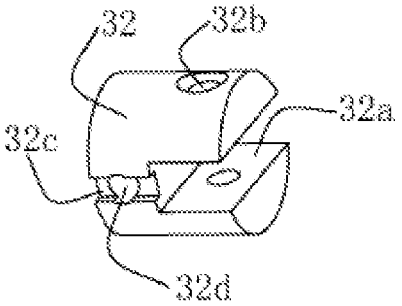
FIG. 3 is a structural schematic diagram of a spring fixing base according to the present invention.

With reference to FIG. 1 to FIG. 3, for the convenience of fixing both ends of the torsional spring 3 in the inner holes of the handles 1 and 2, one spring fixing base 32 is arranged at each of both ends of the torsional spring 3; notches 32*a* and through holes 32*b* perpendicular to the notches are disposed in the spring fixing bases 32; and when end parts of the spring steel pieces are clamped in the notches 32*a*, the through holes 32*b* and through holes 3*a* in the end parts of the spring steel pieces can be penetrated by the rivets or the bolts, so that the spring steel pieces are fixed on the spring fixing bases 32. The spring fixing bases 32 are fixedly connected with the connection ends 1*a* and 2*a* of the handles, so that the torsional spring 3 is connected between the connection ends 1*a* and 2*a* of the two handles. For example, fixing holes 32*d* in the spring fixing bases 32 can be penetrated by the rivets or the bolts, so that the spring fixing bases 32 are fixed in the handles, and certainly can also be fixed in a welding manner, a bonding manner or other well-known manners.

Figure 4:
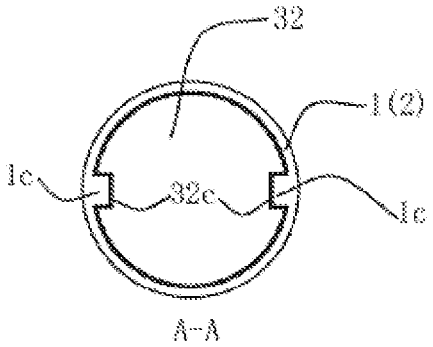
FIG. 4 is a sectional view of A-A in FIG. 1.

As shown in FIG. 3 and FIG. 4, in a preferred embodiment of the present invention, each of the handles 1 and 2 is formed by a circular pipe; the spring fixing bases 32 are also cylindrical and are located in the inner holes of the handles; two convex ribs 1*c* are arranged on inner walls of the circular pipes; and grooves 32*c* matched with the convex ribs 1*c* are disposed in cylindrical surfaces of the spring fixing bases 32. The convex ribs 1*c* can be matched with the grooves 32*c*, so as to connect the spring fixing bases 32 with the handles 1 and 2 more reliably and also play a role of transmitting the torque.

Also with reference to FIG. 1, end surfaces of the connection ends 1*a* and 2*a* of the two handles are brought close to each other; only a small gap is reserved between the end surfaces, so that the torsional spring 3 is integrally accommodated in the inner holes of the two handles; except that both ends of the torsional spring 3 are connected with the handles 1 and 2, the other parts are unrestricted and can be freely subjected to torsional deformation. Preferably, a section of sleeve 4 is further included and sleeved outside the connection ends 1*a* and 2*a* of the two handles; and the sleeve 4 can play a role of shielding the gap between the connection ends 1*a* and 2*a* of the handles and protecting the torsional spring 3, so that the multifunctional muscle exerciser of the present invention is more secure. The sleeve 4 can be fixed on the connection end of one handle. Further, a liner pipe 5 is arranged between the inner wall of the sleeve 4 and an outer wall of the connection end of the handle; the liner pipe 5 is made of a material with a low friction coefficient, and can be fixed on the inner wall of the sleeve 4 or the outer wall of the connection end of the handle; and the liner pipe 5 can prevent the inner wall of the sleeve 4 from directly contacting the outer wall of the connection end of the handle, thereby reducing friction.

Embodiment 2

Figure 5:
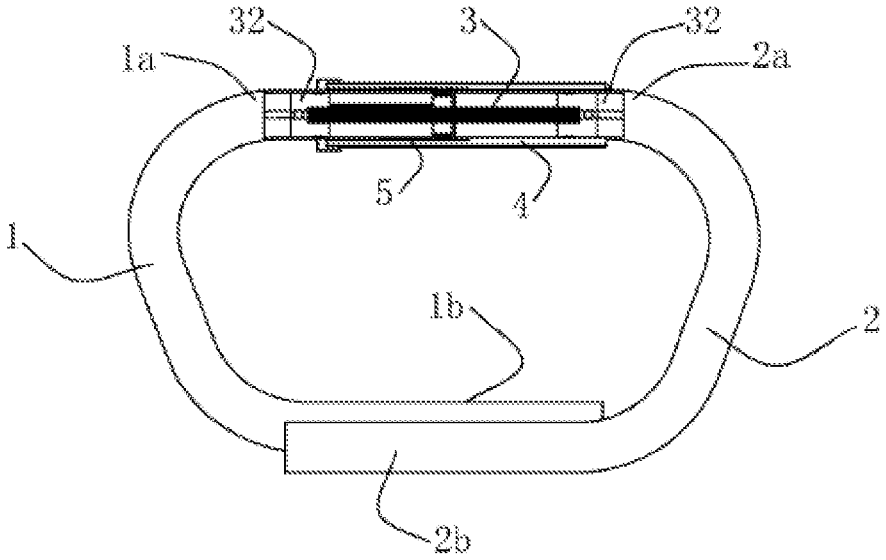
FIG. 5 is a structural schematic diagram of Embodiment 2 of a multifunctional muscle exerciser according to the present invention.
Figure 6:
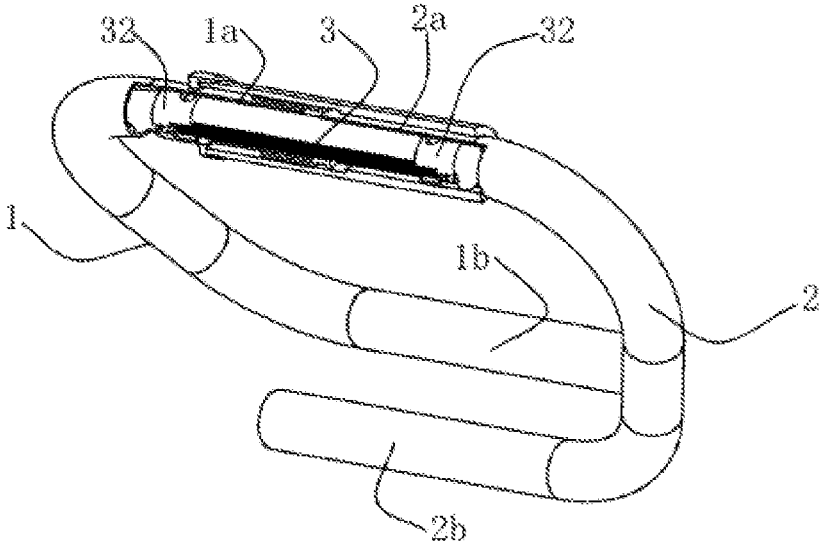
FIG. 6 is a three-dimensional structural schematic diagram of Embodiment 2 of a multifunctional muscle exerciser according to the present invention.
Figure 10:
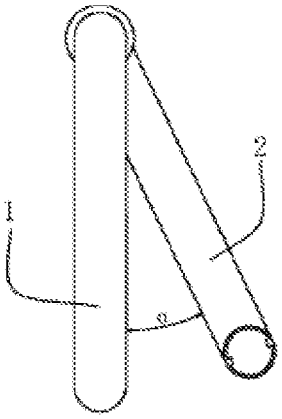
FIG. 10 is a schematic diagram of an angle formed by two handles of a multifunctional muscle exerciser according to the present invention.

As shown in FIG. 5 and FIG. 6, in Embodiment 2 of the present invention, both handles 1 and 2 are U-shaped; the connection ends 1*a* and 2*a* of the two handles are coaxially arranged; the grip ends of the two handles 1*b* and 2*b* are arranged side by side, i.e., from a front view, as shown in FIG. 5, the grip ends 1*b* and 2*b* of the two handles are overlapped with each other in a certain length, but are separated by a certain distance in front and back in a free state; and from a side view, as shown in FIG. 10, an angle is formed between the two handles 1 and 2. A structure of the torsional spring 3 and a connection relationship between the torsional spring 3 and the two handles in the present embodiment are the same as those in Embodiment 1. Other structures, such as the sleeve 4 and the liner pipe 5, may also be arranged in the same manner as that in Embodiment 1.

Lengths of the two handles 1 and 2 are substantially equivalent; since the grip ends 1*b* and 2*b* of the two handles are arranged side by side, the distance between the grip ends 1*b* and 2*b* of the two handles can be further increased or reduced in a push-pull manner after the grip ends are gripped by both hands, or the angle between the two handles 1 and 2 can be changed manually, so that the torsional spring 3 produces elastic force to achieve a purpose of exercising push and pull force of both arms.

Embodiment 3

Figure 7:
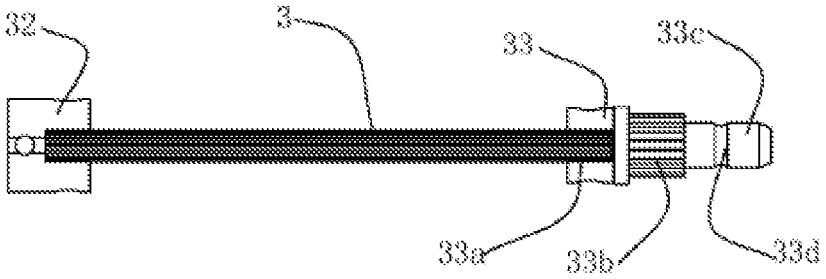
FIG. 7 is a schematic diagram of a torsional spring assembly used in Embodiment 3 of a multifunctional muscle exerciser according to the present invention.
Figure 8:
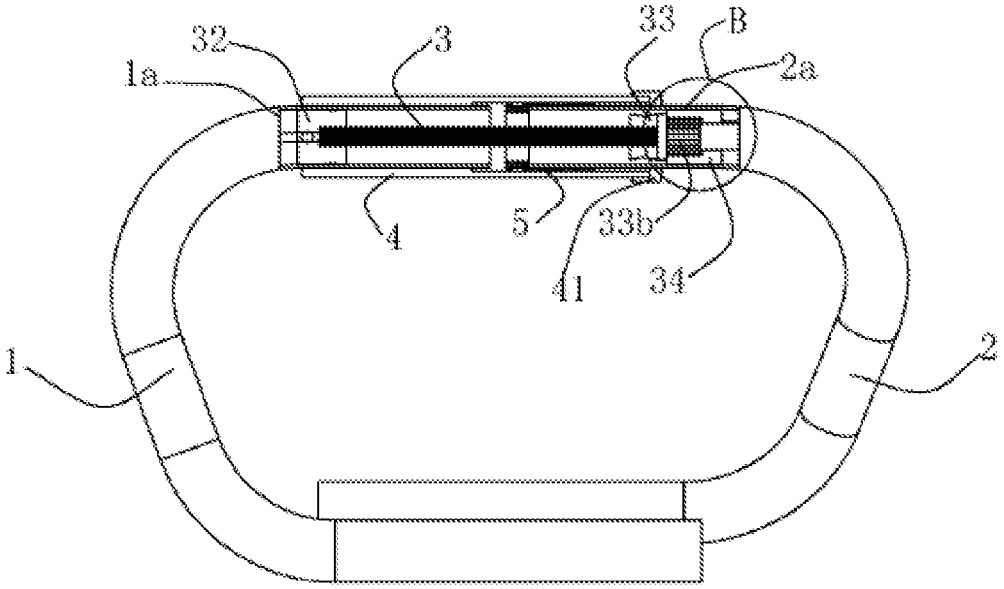
FIG. 8 is a structural schematic diagram of Embodiment 3 of a multifunctional muscle exerciser according to the present invention.
Figure 9:
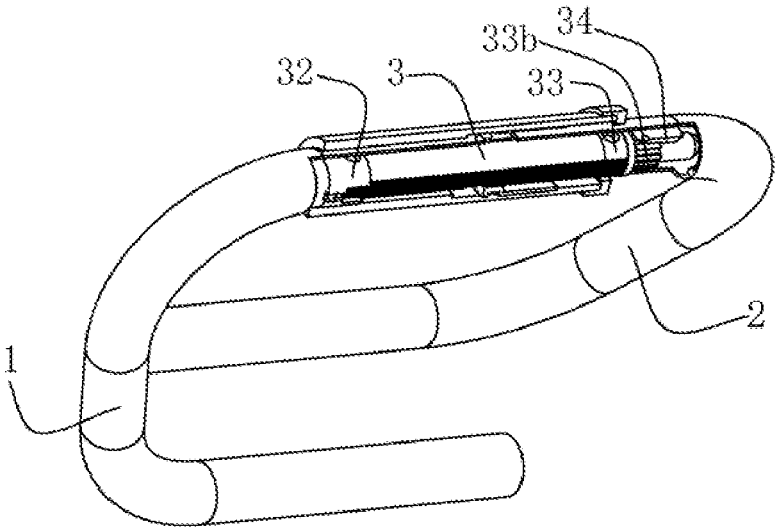
FIG. 9 is a three-dimensional structural schematic diagram of Embodiment 3 of a multifunctional muscle exerciser according to the present invention.

As shown in FIG. 7 to FIG. 9, similar to Embodiment 2, two U-shaped handles and a laminated torsional spring are also adopted in the present embodiment; and the two handles are also formed by bending a circular pipe, but a connection manner of the torsional spring and the two handles in the present embodiment is not the same as that in Embodiment 2.

As shown in FIG. 7, in the present embodiment, a spring fixing base 32 is fixed at one end of the torsional spring 3; the spring fixing base 32 is the same as those in the above two embodiments; a spring clamping base 33 is fixed at the other end of the torsional spring 3; like the spring fixing base 32, a notch 33*a* is also disposed in the spring clamping base 33; and one end part of the spring steel piece is clamped in the notch 33*a* and is fixed on the spring clamping base 33 through the rivet, the bolt or other fasteners. A section of spline shaft 33*b* is further arranged on the spring clamping base 33; and external spline teeth are arranged on the spline shaft 33*b*.

As shown in FIG. 8, the spring fixing base 32 is fixed in a left handle 1; a spline sleeve 34 is arranged in the connection end 2*a* of a right handle 2; an internal spline tooth is arranged in the spline sleeve 34; the spline shaft 33*b* on the spring clamping base can be inserted into the spline sleeve 34 and is matched with the spline sleeve 34 through a spline (this state is hereinafter referred to as the two handles are in a closed state); and in a process of using the multifunctional muscle exerciser, the spline cooperates to play a role of transmitting the torque. Two convex ribs (see 1*c* in FIG. 4) can also be arranged on the inner walls of the two handles; and grooves matched with the convex ribs are also arranged on cylindrical surfaces of the spring fixing base 32 and the spline sleeve 34. The convex ribs are matched with the grooves, so as to connect the spring fixing base 32, the spline sleeve 34 and the handles 1 and 2 more reliably, and also play a role of transmitting the torque.

Figure 11:
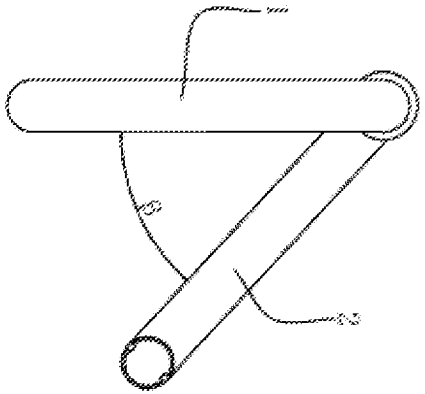
FIG. 11 is a schematic diagram of another angle formed by the two handles of the multifunctional muscle exerciser according to the present invention.

When the left handle 1 is pulled and the connection end 1*a* of the left handle is moved outward (leftward) relative to the connection end 2*a* of the right handle 2, the torsional spring 3 can be driven to move outward together with the spring clamping base 33 at the end of the torsional spring, so that the spline shaft 33*b* is separated from the spline sleeve 34 (this state is hereinafter referred to as the two handles are in an open state), and the left handle 1 is free to rotate relative to the right handle 2. If the spline shaft 33*b* is reinserted into the spline sleeve 34 after the left handle 1 is rotated at an angle relative to the right handle 2, an initial distance between the grip ends 1*b* and 2*b* of the two handles can be easily adjusted, or an initial (in a free state) angle between the two handles 1 and 2 is adjusted, e.g., from a relatively small angle $\alpha$ shown in FIG. 10 to a relatively large angle $\beta$ shown in FIG. 11, or from the relatively large angle $\beta$ to the relatively small angle $\alpha$.

The initial angle between the two handles 1 and 2 is changed. The force to be applied by both arms may also be changed when the multifunctional muscle exerciser is used. Therefore, the multifunctional muscle exerciser in the present embodiment can adjust the torque conveniently.

In addition, when the initial distance between the grip ends 1*b* and 2*b* of the two handles (or the initial angle between the two handles 1 and 2) is relatively appropriate, the grip ends 1*b* and 2*b* of the two handles can be gripped by one hand at the same time; and therefore, the multifunctional muscle exerciser in the present embodiment can also be used as a grip exerciser, and thus has multiple functions.

As shown in FIG. 7 to FIG. 9, the end of the spline shaft 33*b* extends forward to form a section of guide shaft 33*c* on the spring clamping base 33; the diameter of the guide shaft 33*c* is smaller than that of a tooth root circle of the spline shaft 33*b*; and a guide hole matched with the guide shaft 33*c* is disposed in the spline sleeve 34. After the spline shaft 33*b* is separated from the spline sleeve 34, the guide shaft 33*c* remains in the spline sleeve 34; and when the spline shaft 33*b* is reinserted into the spline sleeve 34, the guide shaft 33*c* can play a role of guiding, so that the spline shaft 33*b* can be inserted into the spline sleeve 34 easily.

Figure 12:
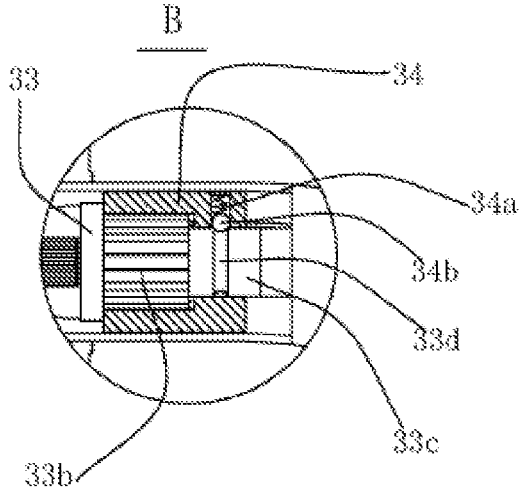
FIG. 12 is a partial enlarged view of a position B in FIG. 8.

As shown in FIG. 7 and FIG. 12, a more optimized structure further comprises an insertion positioning mechanism arranged between the guide shaft 33*c* and the handles; one or more annular grooves 33*d* are disposed in the cylindrical surface of the guide shaft 33*c*; a jacking bead 34*b* is arranged in the connection end 2*a* of the handle (e.g., on the spline sleeve 34) along a radial direction; the jacking bead 34*b* is in contact with the spring 34*a*; under the action of the spring 34*a*, part of a spherical surface of the jacking bead 34*b* may be protruded from the inner wall of the guide hole. When the spline shaft 33*b* is partially matched with the spline sleeve 34, i.e., when an external spline tooth on the spline shaft 33*b* and an internal spline tooth of the spline sleeve 34 are meshed with each other in partial length, the jacking bead 34*b* can slide along the cylindrical surface of the guide shaft 33*c*; when the spline shaft 33*b* is completely matched with the spline sleeve 34, i.e., when the external spline tooth on the spline shaft 33*b* and the internal spline tooth of the spline sleeve 34 are meshed with each other in full length, the jacking bead 34*b* is just clamped into the annular groove 33*d* to realize positioning, i.e., the annular groove 33*d* and the jacking bead 34*b* constitute the insertion positioning mechanism. A user can know whether the jacking bead 34*b* is clamped into the annular groove 33*d* by a hand feel, to determine whether the spline shaft 33*b* is completely matched with the spline sleeve 34, to avoid damaging the spline shaft 33*b* or the spline sleeve 34 due to the use of the multifunctional muscle exerciser when the spline shaft 33*b* is partially matched with the spline sleeve 34.

As shown in FIG. 8 and FIG. 9, in the present embodiment, the sleeve 4 can also be arranged outside the connection ends 1*a* and 2*a* of the two handles; one end of the sleeve 4 is fixed at the connection end of one handle; the liner pipe 5 can also be arranged between the inner wall of the sleeve 4 and the outer wall of the connection end of the other handle. The sleeve 4 and the liner pipe 5 also each have functions described in Embodiment 1; and meanwhile, the sleeve 4 and the liner pipe 5 in the present embodiment are also used to constitute a limiting mechanism between the two handles. When the connection ends 1*a* and 2*a* of the two handles are separated by a distance and the spline shaft 33*b* is completely separated from the spline sleeve 34, the limiting mechanism is used for preventing the connection ends 1*a* and 2*a* of the two handles from continuing to be separated, thereby avoiding that the two handles are completely separated during use and ensuring integrity and use security of the multifunctional muscle exerciser of the present invention. As shown in FIG. 8, the liner pipe 5 is fixed at the connection end 2*a* of the right handle 2; an outer diameter of the liner pipe 5 is greater than that of the connection end 2*a* of the right handle; however, a left end of the sleeve 4 is fixed on the connection end 1*a* of the left handle; a right end of the sleeve 4 extends to outside of the connection end 2*a* of the right handle 2; a baffle ring 41 is fixed at the right end of the sleeve 4; an inner diameter of the baffle ring 41 is smaller than the outer diameter of the liner pipe 5; when the connection ends of the two handles are separated by a certain distance, the spline shaft 33*b* is completely separated from the spline sleeve 34; at this moment, a right end surface of the liner pipe 5 is in contact with the baffle ring 41, so that the connection ends of the two handles cannot be separated continuously, i.e., the liner pipe 5 constitutes a protrusion part, and the liner pipe 5 and the baffle ring 41 at the end part of the sleeve 4 constitute the limiting mechanism.

Embodiment 4

The present embodiment is an improvement of Embodiment 3, and can comprise all structures described above in Embodiment 3. On the basis of Embodiment 3, in the present embodiment, an angle limiting mechanism is added between the two handles; functions of the angle limiting mechanism are that when the angle between the two handles in the free state is in a certain range (e.g. 30-150 degrees) and the two handles are extruded in a left-right direction, the two handles can be changed from the open state to the closed state, i.e., a state that the spline shaft 33*b* is meshed with the spline sleeve 34 (see FIG. 8); but when the angle between the two handles in the free state exceeds a preset value (e.g. 150 degrees), the two handles cannot be changed from the open state to the closed state even if the two handles are extruded forcibly from the left-right direction to the middle, i.e., the connection ends of the two handles cannot get close enough, causing that the spline shaft 33*b* cannot be inserted into the spline sleeve 34; the two handles can only be idled relatively at this moment; and the multifunctional muscle exerciser cannot be used normally.

As described in Embodiment 3, the initial angle between the two handles of the multifunctional muscle exerciser is adjustable. However, if the user adjusts the initial angle between the two handles to a large value (e.g. close to 180 degrees), the torsional spring may be greatly deformed and produce large elastic force in a process of using the multifunctional muscle exerciser, which may cause slipping-off due to grip difficulty, or cause damage to the torsional spring or other components, and further pose risks to the user. Therefore, in the present embodiment, the angle limiting mechanism is arranged to better ensure the security of the multifunctional muscle exerciser and the user. The angle limiting mechanism is composed of an outer gear ring and an inner gear ring; convex teeth and tooth grooves matched with each other are arranged between the outer gear ring and the inner gear ring; the convex teeth comprise at least one special convex tooth; the tooth grooves comprise at least one special tooth groove; and the special convex tooth may be inserted into other tooth grooves other than the special tooth groove.

Figure 13:
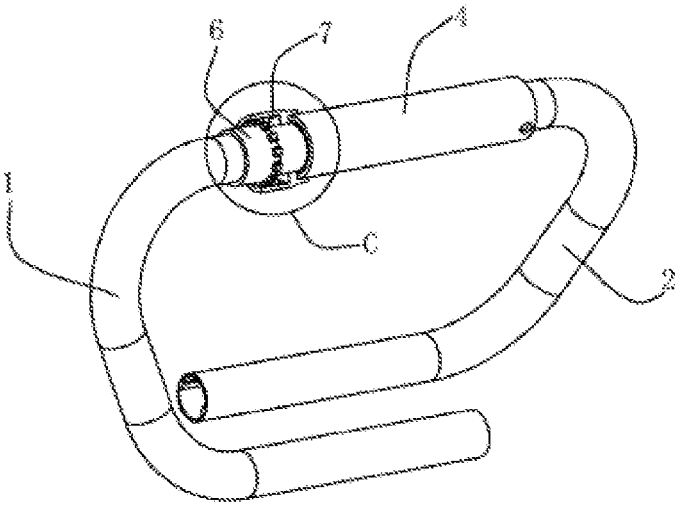
FIG. 13 is a three-dimensional structural schematic diagram of Embodiment 4 of a multifunctional muscle exerciser according to the present invention.
Figure 14:
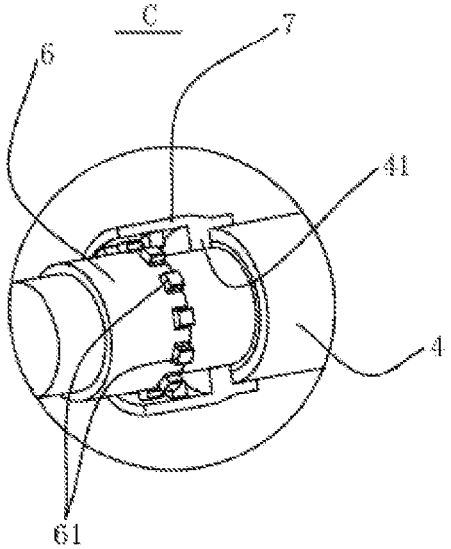
FIG. 14 is a partial enlarged view of a position C in FIG. 13.
Figure 15:
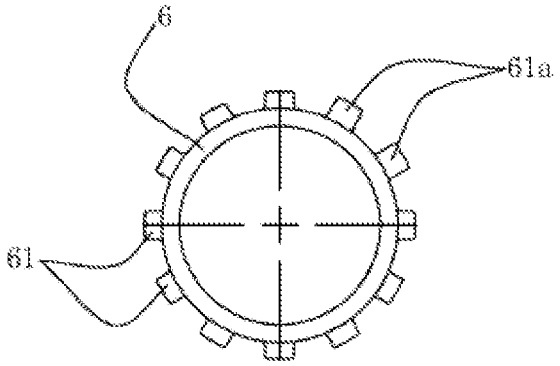
FIG. 15 is a schematic diagram of an external gear ring used in Embodiment 4 of a multifunctional muscle exerciser according to the present invention.
Figure 16:
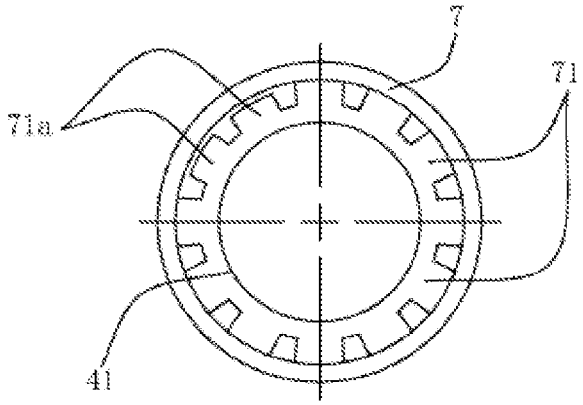
FIG. 16 is a schematic diagram of an internal gear ring used in Embodiment 4 of the multifunctional muscle exerciser according to the present invention.

As shown in FIG. 13 and FIG. 14, the sleeve 4 is fixed on the right handle 2; the inner gear ring 7 is fixed at the left end of the sleeve 4; the outer gear ring 6 is fixed on the left handle 1; a plurality of convex teeth 61 are uniformly arranged along an outer circumference on the outer gear ring 6; and as shown in FIG. 15, these convex teeth comprise at least one special convex tooth 61*a*. As shown in FIG. 16, a plurality of tooth grooves 71 are uniformly arranged along an inner circumference on the inner gear ring 7; these tooth grooves comprise at least one special tooth groove 71*a*, and the special convex tooth 61*a* can be inserted into other tooth grooves other than the special tooth groove 71*a*. The number of teeth of the inner gear ring 7 is the same as that of the outer gear ring 8, and is set as N; the number of teeth of the spline shaft 33*b* is also the same as that of the spline sleeve 34, and is set as n; and N is equal to n, or N is an integral multiple of n.

In addition, as shown in FIG. 13 and FIG. 14, the inner gear ring 7 may be integrally formed at the left end of the sleeve 4 as a part of the sleeve 4, or may be fixed at the left end of the sleeve 4 as an independent member; and the baffle ring 41 mentioned in Embodiment 3 may also be formed inside the inner gear ring 7.

In FIG. 15 to FIG. 18, twelve convex teeth and twelve tooth grooves are provided, wherein two special convex teeth 61*a* are provided and are arranged adjacent to each other; and two special tooth grooves 71*a* are also provided and are arranged adjacent to each other. However, it is apparent that the number of the convex teeth and the number of the tooth grooves are not limited to twelve; and the number of the special convex teeth 61*a* and the number of the special tooth grooves 71*a* are not limited to two. Widths of all the convex teeth (including the special convex teeth) are the same, but heights of the special convex teeth 61*a* are greater than those of the other convex teeth; the widths of all the tooth grooves (including the special tooth grooves) are the same, and are greater than the widths of the convex teeth; a certain amount of clearance is reserved on both sides during matching, to ensure that the spline shaft 33*b* can be smoothly meshed with the spline shaft 34 in the free state of the torsional spring 3 when the outer gear ring 6 is meshed with the inner gear ring 7. But, the depths of the special tooth grooves 71*a* are slightly smaller than those of the other tooth grooves; the depths of the special tooth grooves 71*a* make the special convex teeth 61*a* fail to pass, but allow the other convex teeth to pass smoothly.

Figure 17:
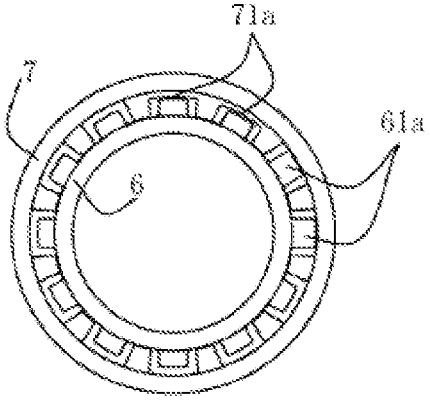
FIG. 17 shows a relative positional relationship between the inner gear ring and the outer gear ring in a circumferential direction in Embodiment 4 of the present invention.
Figure 18:
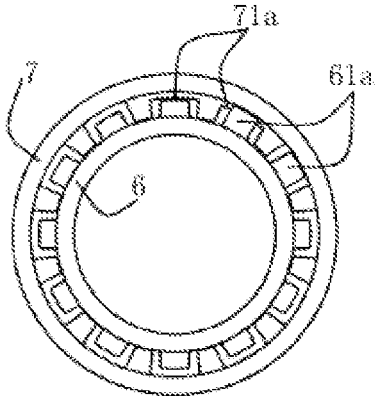
FIG. 18 shows another relative positional relationship between the inner gear ring and the outer gear ring in the circumferential direction in Embodiment 4 of the present invention.

As shown in FIG. 17, when the positions of the special convex teeth 61*a* and the special tooth grooves 71*a* do not coincide in a circumferential direction, all the convex teeth can pass through the tooth grooves, so that the two handles can be changed from the open state to the closed state, and the multifunctional muscle exercises can work properly. As shown in FIG. 18, as long as positions of one special convex tooth 61*a* and one special tooth groove 71*a* are overlapped in the circumferential direction, the connection ends of the two handles cannot get close since the depth of the special tooth groove 71*a* makes the special convex tooth 61*a* fail to pass; and the spline shaft 33*b* cannot be inserted into the spline sleeve 34 so that the two handles cannot be changed to the closed state, and the multifunctional muscle exerciser cannot work properly. Therefore, as long as the positions of the special convex teeth 61*a* and the special tooth grooves 71*a* are appropriately set so that the angle between the two handles in the free state exceeds a preset value, and the positions of the special convex teeth 61*a* and the special tooth grooves 71*a* are overlapped in the circumferential direction, the purpose of limiting the angle between the handles can be achieved.

Figure 19A:
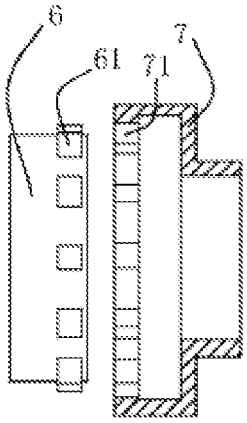
FIG. 19*a* shows a first relative positional relationship between the inner gear ring and the outer gear ring in an axial direction in Embodiment 4 of the present invention.
Figure 19B:
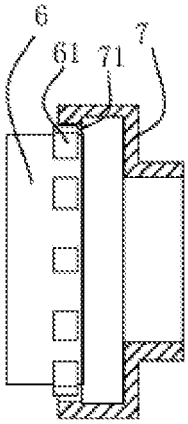
FIG. 19*b* shows a second relative positional relationship between the inner gear ring and the outer gear ring in the axial direction in Embodiment 4 of the present invention.
Figure 19C:
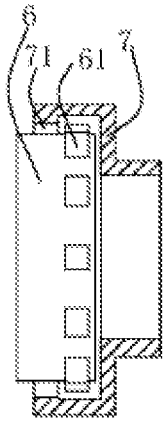
FIG. 19*c* shows a third relative positional relationship between the inner gear ring and the outer gear ring in the axial direction in Embodiment 4 of the present invention.

As described above, when the two handles are changed from the open state to the closed state, the spline shaft 33*b* and the spline sleeve 34 (see FIG. 8) start to be matched in partial length at first, and if there is no restriction measure, and torque is applied to the two handles at this moment, the spline shaft 33*b* or the spline sleeve 34 may be damaged. To avoid this situation, relative positions of the outer gear ring 6 and the inner gear ring 7 in an axial direction may be set in such a manner that the outer gear ring 6 and the gear ring 7 are also in a separated state (as shown in FIG. 19*a*) when the spline shaft 33*b* is completely separated from the spline sleeve 34, and the convex teeth 61 start to be inserted into the tooth grooves 71 when the outer gear ring 6 starts to enter the inner gear ring 7 (as shown in FIG. 19*b*), and then, the spline shaft 33*b* and the spline sleeve 34 start to be meshed in partial length; at this moment, if the torque is applied to the two handles, since the convex teeth 61 and the tooth grooves 71 are mutually limited, the two handles are stuck with each other, the multifunctional muscle exerciser cannot work properly, to avoid possible damage since the spline shaft 33*b* or the spline sleeve 34 is used when the meshing length is too short; therefore, the angle limiting mechanism further has a function of protecting the spline shaft 33*b* or the spline sleeve 34, besides the function of limiting the angle between the handles; when the spline shaft 33*b* is completely matched with the spline sleeve 34, the outer gear ring 6 also completely enters the inner gear ring 7 (as shown in FIG. 19*c*); at this moment, the convex teeth 61 have passed over the tooth grooves 71 and are separated from the tooth grooves 71; the convex teeth 61 and the tooth grooves 71 are no longer limited to each other; the two handles can rotate relatively; and the multifunctional muscle exerciser can work properly.

Figure 20:
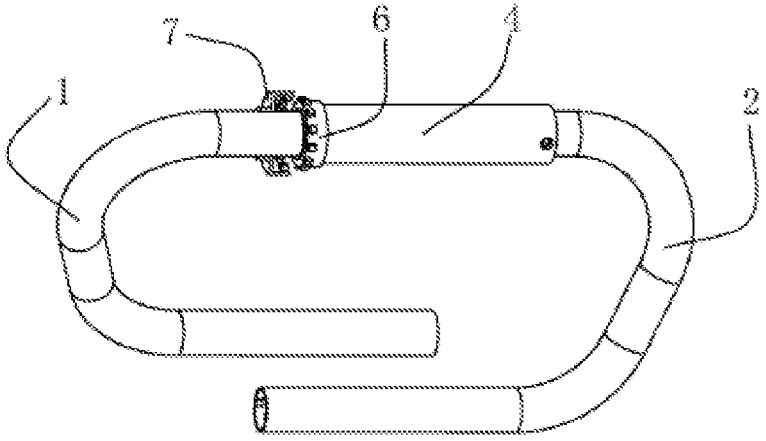
FIG. 20 is another three-dimensional structural schematic diagram of Embodiment 4 of a multifunctional muscle exerciser according to the present invention.

As shown in FIG. 20, the angle limiting mechanism is arranged in another manner that the sleeve 4 is still fixed on the right handle 2, but the positions of the outer gear ring 6 and the inner gear ring 7 are interchanged, i.e., the outer gear ring 6 is fixed at the left end of the sleeve 4, and the inner gear ring 7 is fixed on the left handle 1; the convex teeth on the outer gear ring 6 and the tooth grooves in the gear ring 7 are still provided in the same manner; and the functions of the angle limiting mechanism can also be realized in this manner. The advantage of this manner is that the outer diameter of the inner gear ring 7 can be reduced, thereby reducing the volume of the entire multifunctional muscle exerciser.

Embodiment 5

Figure 21:
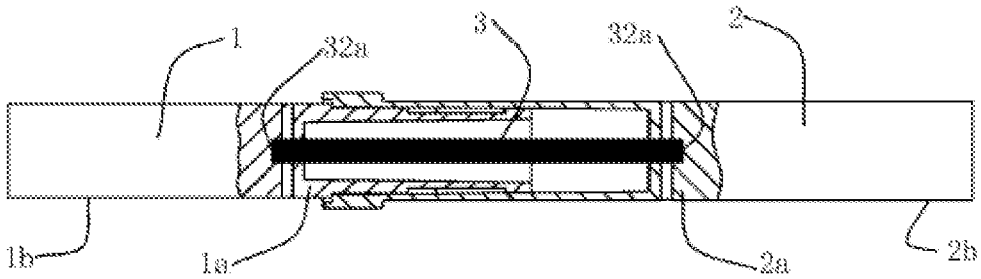
FIG. 21 is a structural schematic diagram of Embodiment 5 of a multifunctional muscle exerciser according to the present invention.
Figure 22:
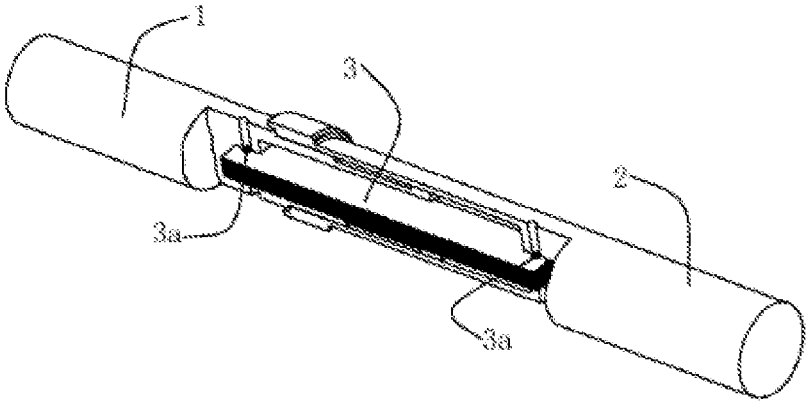
FIG. 22 is a three-dimensional schematic diagram of Embodiment 5 of a multifunctional muscle exerciser according to the present invention.

As shown in FIG. 21 and FIG. 22, the multifunctional muscle exerciser in the present embodiment comprises left and right handles 1 and 2; the two handles 1 and 2 each comprise a connection end 1*a*, 2*a* and a grip end 1*b*, 2*b*; a torsional spring 3 is connected between the connection ends 1*a* and 2*a* of the two handles; and the structure of the torsional spring 3 is the same as that of Embodiment 1. Unlike the Embodiment 1, the two handles 1 and 2 in the present embodiment are made of engineering plastics; the notches 32*a* for clamping the torsional spring 3 can be directly formed in the connection ends 1*a* and 2*a* of the two handles in a molding manner; and therefore, in the present embodiment, an independent spring fixing base is not required to be provided. Both ends of the torsional spring 3 clamped in the notches 32*a* can also be fixed on the two handles by rivets or screws.

Embodiment 6

Figure 23:
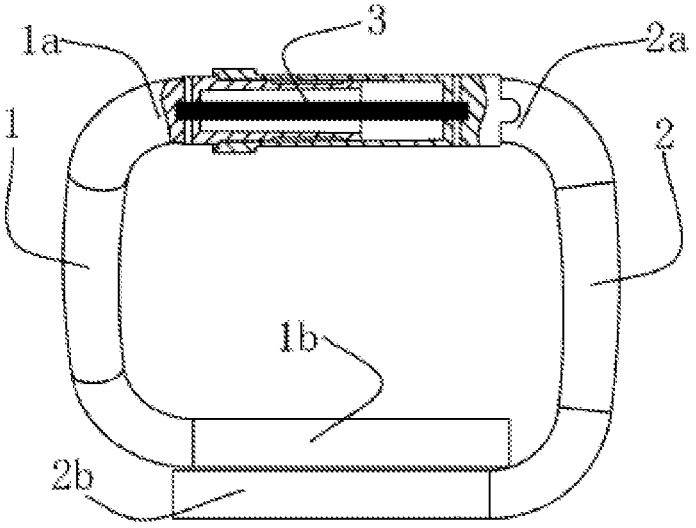
FIG. 23 is a structural schematic diagram of Embodiment 6 of a multifunctional muscle exerciser according to the present invention.
Figure 24:
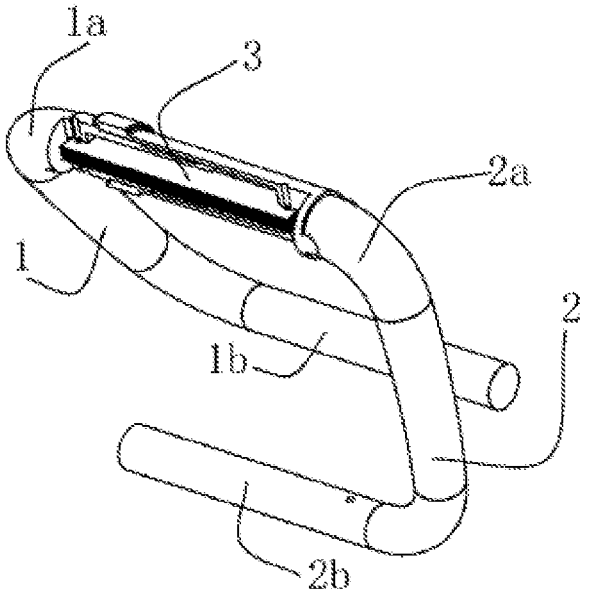
FIG. 24 is a three-dimensional schematic diagram of Embodiment 6 of a multifunctional muscle exerciser according to the present invention.

As shown in FIG. 23 and FIG. 24, in Embodiment 6 of the present invention, the two handles 1 and 2 have shapes same as those in Embodiment 2 and are U-shaped; but the two handles 1 and 2 are directly molded by engineering plastics. In the present embodiment, the structure of the torsional spring 3 and the connection relationship between the torsional spring 3 and the two handles are the same as those in Embodiment 5.

Embodiment 7

Figure 25:
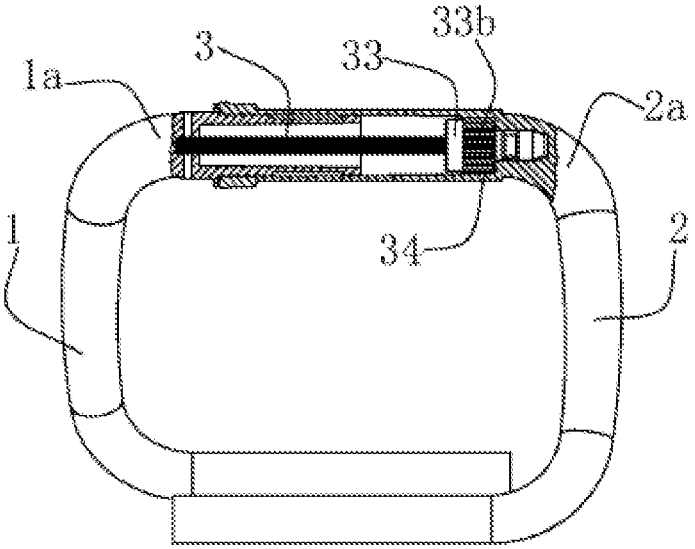
FIG. 25 is a structural schematic diagram of Embodiment 7 of a multifunctional muscle exerciser according to the present invention.
Figure 26:
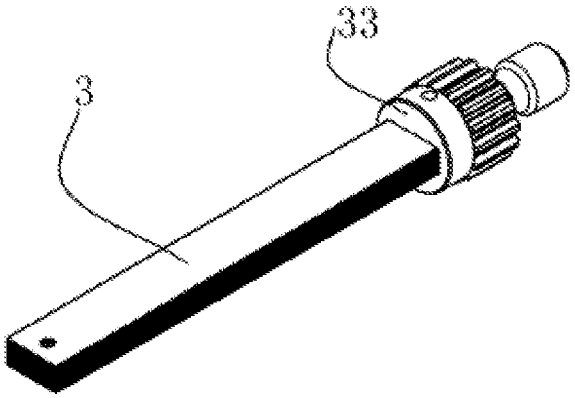
FIG. 26 is a schematic diagram of a combination state of a torsional spring and a spring clamping base.
Figure 27:
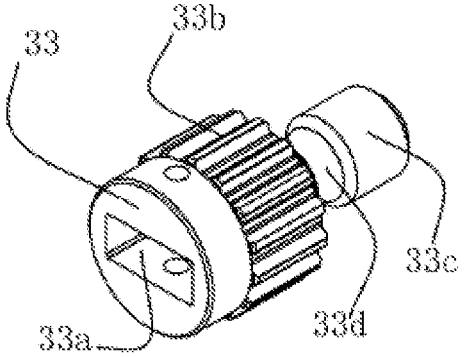
FIG. 27 is a three-dimensional structural schematic diagram of a spring clamping base.

As shown in FIG. 25 to FIG. 27, similar to Embodiment 6, the two U-shaped handles and the laminated torsional spring are also adopted in the present embodiment; and the two handles are directly molded by engineering plastics. However, the connection manner between the torsional spring and the two handles in the present embodiment is different from that in Embodiment 6.

As shown in FIG. 25, one end of the torsional spring 3 is directly fixed in the connection end 1*a* of the left handle; a spring clamping base 33 is fixed at the other end of the torsional spring 3; the notch 33*a* (see FIG. 27) is disposed in the spring clamping base 33; and the other end of the torsional spring 3 is clamped in the notch 33*a* and is fixed on the spring clamping base 33 through rivets, bolts or other fasteners.

As shown in FIG. 27, the structure of the spring clamping base 33 is the same as that in Embodiment 3; a section of spline shaft 33*b* is also arranged on the spring clamping base; and external spline teeth are arranged on the spline shaft 33*b*. The end of the spline shaft 33*b* further extends forward to form a section of guide shaft 33*c*; and the diameter of the guide shaft 33*c* is smaller than that of a tooth root circle of the spline shaft 33*b*. Functions of the guide shaft 33*c* are the same as those in Embodiment 3.

As shown in FIG. 25, the spline sleeve 34 is arranged in the connection end 2*a* of the right handle 2; and the spline sleeve 34 is also directly formed in the connection end 2*a* of the right handle 2 in a molding manner. The spline shaft 34 is provided with internal spline teeth; the spline shaft 33*b* on the spring clamping base can be inserted into the spline sleeve 34 and is matched with the spline sleeve 34 through a spline; and the matching function and the use manner of the spline are the same as those in Embodiment 3.

Embodiment 8

Figure 28:
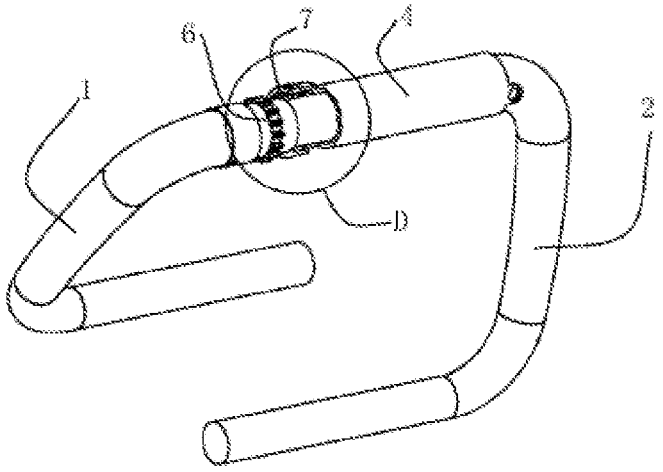
FIG. 28 is a three-dimensional schematic diagram of Embodiment 8 of a multifunctional muscle exerciser according to the present invention.
Figure 29:
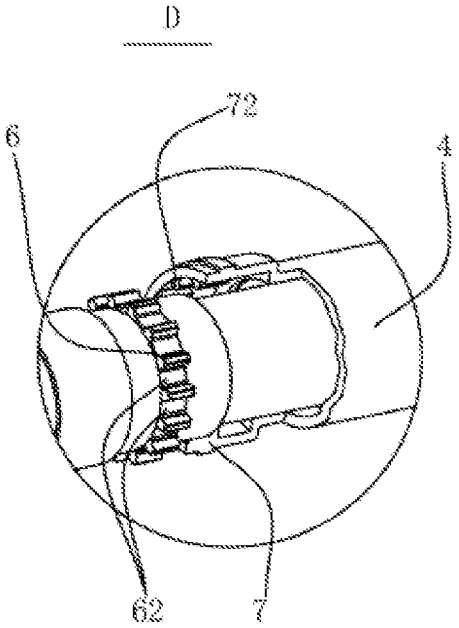
FIG. 29 is a partial enlarged view of a position D in FIG. 28.
Figure 30:
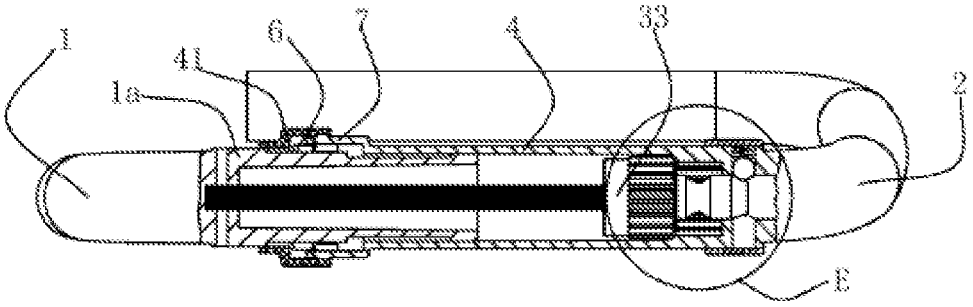
FIG. 30 is a structural sectional view of Embodiment 8 of a multifunctional muscle exerciser according to the present invention.

As shown in FIG. 28 to FIG. 30, Embodiment 8 is an improvement of Embodiment 7, and may comprise all the structures described above in Embodiment 7. On the basis of Embodiment 7, in the present embodiment, the angle limiting mechanism is added between the two handles; and functions of the angle limiting mechanism are the same as those in Embodiment 4. The angle limiting mechanism is also composed of an outer gear ring and an inner gear ring; and the convex teeth and the tooth grooves matched with each other are arranged between the outer gear ring and the inner gear ring; these convex teeth comprise at least one special convex tooth; these tooth grooves comprise at least one special tooth groove; and the special convex tooth can be inserted into other tooth grooves other than the special tooth groove.

Figure 32:
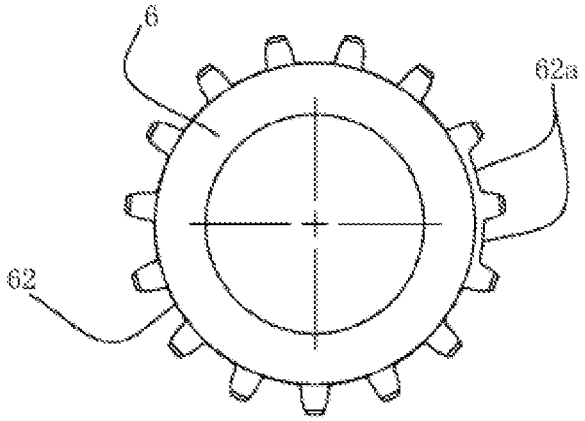
FIG. 32 is a schematic diagram of an outer gear ring used in Embodiment 8 of a multifunctional muscle exerciser according to the present invention.
Figure 33:
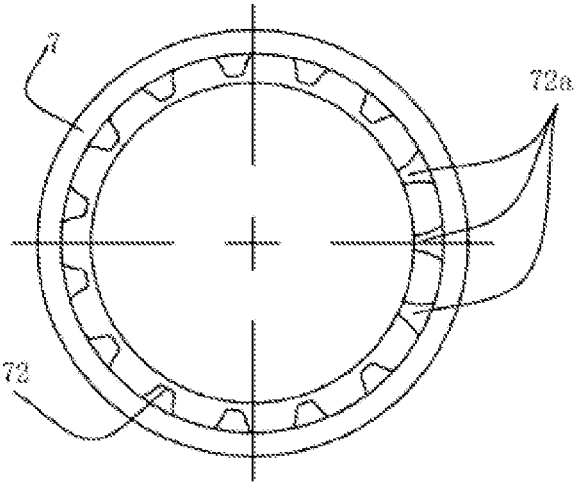
FIG. 33 is a schematic diagram of an inner gear ring used in Embodiment 8 of a multifunctional muscle exerciser according to the present invention.

As shown in FIG. 28 and FIG. 29, the sleeve 4 is integrally formed on the right handle 2 in a molding manner and extends forward (leftward) from the connection end of the right handle; the inner gear ring 7 is integrally formed at the left end of the sleeve 4; the outer gear ring 6 is integrally formed on the left handle 1 in a molding manner; and a plurality of convex grooves 62 are uniformly formed along the outer circumference on the outer gear ring 6. As shown in FIG. 32, these tooth grooves comprise at least one special tooth groove 62*a*. As shown in FIG. 33, a plurality of convex teeth 72 same as the tooth grooves in number are uniformly arranged along the inner circumference on the inner gear ring 7; these convex teeth comprise at least one special convex tooth 72; and the special convex tooth 72 can be inserted into other tooth grooves other than the special tooth groove 62*a*.

In FIG. 32 to FIG. 35, fifteen convex teeth and fifteen tooth grooves are provided, wherein three special convex teeth 72 are provided and are arranged adjacent to each other; two special tooth grooves 62*a* are provided and are arranged adjacent to each other. The widths of all the convex teeth (including the special convex teeth) are the same, but the heights of the special convex teeth 72*a* are slightly greater than those of other convex teeth; the widths of all the tooth grooves (including the special tooth grooves) are the same and are greater than those of the convex teeth, but the depths of the special tooth grooves 62*a* are slightly smaller than those of other tooth grooves; and the depths of the special tooth grooves 62*a* make the special convex teeth 72*a* fail to pass, but allow other convex teeth to pass smoothly.

Figure 34:
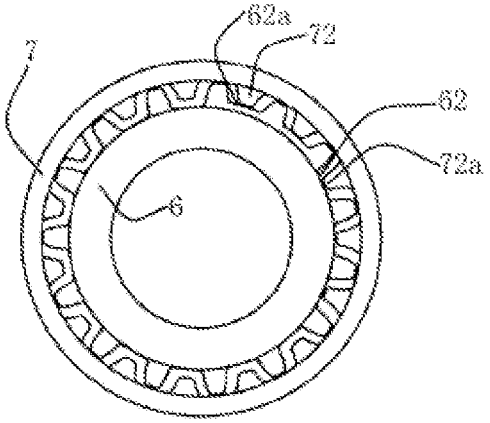
FIG. 34 shows a relative positional relationship between the inner gear ring and the outer gear ring in the circumferential direction in Embodiment 8 of the present invention.
Figure 35:
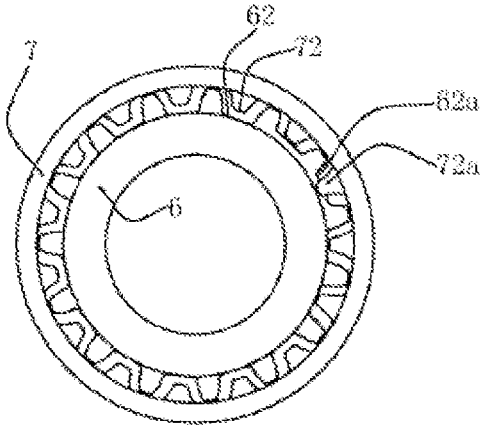
FIG. 35 shows another relative positional relationship between the inner gear ring and the outer gear ring in the circumferential direction in Embodiment 8 of the present invention.

As shown in FIG. 34, when the positions of the special convex teeth 72*a* and the special tooth grooves 62*a* in the circumferential direction do not coincide, all the convex teeth can pass from the tooth grooves, so that the two handles can be changed from the open state to the closed state, and the multifunctional muscle exerciser can work properly. As shown in FIG. 35, as long as positions of one special convex tooth 72*a* and one special tooth groove 62*a* are overlapped in the circumferential direction, the connection ends of the two handles cannot get close since the depth of the special tooth groove 62*a* makes the special convex tooth 72*a* fail to pass; and the spline shaft cannot be inserted into the spline sleeve so that the two handles cannot be changed to the closed state, and the multifunctional muscle exerciser cannot work properly. Therefore, as long as the positions of the special convex teeth 72*a* and the special tooth grooves 62*a* are appropriately set so that the angle between the two handles in the free state exceeds a preset value, and the positions of the special convex teeth 72*a* and the special tooth grooves 62*a* are overlapped in the circumferential direction, the purpose of limiting the angle between the handles can be achieved.

The relative positions of the outer gear ring 6 and the inner gear ring 7 in the axial direction can also be set in the manner described in Embodiment 4 (FIG. 19*a* to FIG. 19*c*) so as to realize the function of protecting the spline shaft and the spline sleeve.

In addition, as shown in FIG. 30, a baffle ring 41 can also be fixed at the left end of the sleeve 4; and for the need of assembly, the baffle ring 41 is an independent member and is not integrally formed with the sleeve 4. The right end of the baffle ring 41 is fixed at the left end of the sleeve 4; the left end of the baffle ring 41 is sleeved outside the connection end 1*a* of the left handle, but the inner diameter of the left end of the baffle ring 41 is smaller than the outer diameter of the outer gear ring 6; when the connection ends of the two handles are separated by a certain distance, the spline shaft is completely separated from the spline sleeve; at this moment, the outer gear ring 6 is in contact with the baffle ring 41 so that the connection ends of the two handles cannot be separated continuously, i.e., the outer gear ring 6 constitutes a protrusion part, so that the outer gear ring 6 and the baffle ring 41 also constitute a limiting mechanism. The functions of the limiting mechanism are the same as those described in Embodiment 3.

Figure 31:
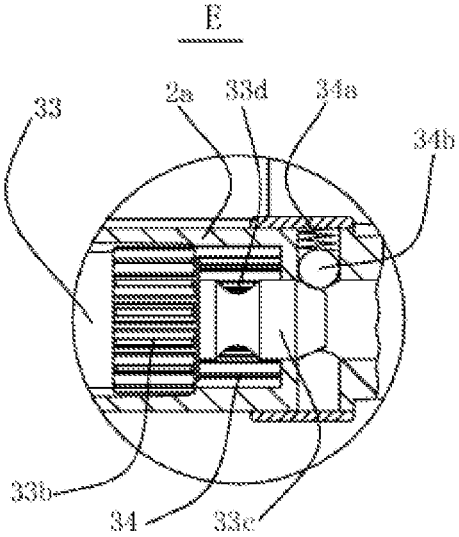
FIG. 31 is a partial enlarged view of a position E in FIG. 30.

The present embodiment can also comprise the insertion positioning mechanism as described in Embodiment 3. As shown in FIG. 30 and FIG. 31; a section of annular groove 33*d* is disposed in the cylindrical surface of the guide shaft 33*c*; a guide hole matched with the guide shaft 33*c* is disposed in the connection end of the right handle; a jacking bead 34*b* is arranged on a hole wall of the guide hole in the radial direction; the jacking bead 34*b* is in contact with the spring 34*a*; and under the action of the spring 34*a*, part of the spherical surface of the jacking bead 34*b* may be protruded from the inner wall of the guide hole. When the spline shaft 33*b* is partially matched with the spline sleeve 34, i.e., when the external spline tooth on the spline shaft 33*b* and the internal spline tooth of the spline sleeve 34 are meshed with each other in partial length, the jacking bead 34*b* can slide along the cylindrical surface of the guide shaft 33*c*; when the spline shaft 33*b* is completely matched with the spline sleeve 34, i.e., when the external spline tooth on the spline shaft 33*b* and the internal spline tooth of the spline sleeve 34 are meshed with each other in full length, the jacking bead 34*b* is just clamped into the annular groove 33*d* to realize positioning, i.e., the annular groove 33*d* and the jacking bead 34*b* constitute the insertion positioning mechanism.

Although the title of the present invention is a multifunctional muscle exerciser which can be used for exercising muscles of arms and shoulders, if the two handles are clamped by two legs, the multifunctional muscle exerciser can also be used for exercising the muscles of inner thighs and buttocks. Accordingly, the protection scope of the present invention should be defined by the structures recorded in claims and should not be limited by the use manner.

The above are merely preferred embodiments of the present invention. It should be noted that several improvements and replacements can also be made by those ordinary skilled in the art without departing from technical principles of the present invention, and these improvements and replacements should also be regarded as the protection scope of the present invention.

I claim:

1. A multifunctional muscle exerciser, comprising two handles (1, 2), wherein the two handles (1, 2) each comprise a connection end (1*a*, 2*a*) and a grip end (1*b*, 2*b*); a torsional spring (3) is connected between the connection ends (1*a*, 2*a*) of the two handles (1, 2); the torsional spring (3) is composed of a plurality of stacked spring steel pieces (31); both ends of the plurality of spring steel pieces (31) are respectively connected via fasteners; the two handles (1, 2) are U-shaped; connection ends (1*a*, 2*a*) of the two handles (1, 2) are coaxially arranged; the grip ends (1*b*, 2*b*) of the two handles (1, 2) are arranged side by side; one end of the torsional spring (3) is fixedly connected with the connection end (1*a*) of one handle (1), and the other end is fixedly connected with a spring clamping base (33); a spline sleeve (34) is arranged in the connection end (2*a*) of the other handle (2); a section of spline shaft (33*b*) is arranged on the spring clamping base (33); and the spline shaft (33*b*) is matched with the spline sleeve (34).

2. The multifunctional muscle exerciser according to claim 1, wherein the handles (1, 2) are molded by engineering plastics.

3. The multifunctional muscle exerciser according to claim 1, wherein the connection ends (1*a*, 2*a*) of the two handles (1, 2) are provided with notches (32*a*, 33*a*); and end parts of the spring steel pieces (31) are clamped in the notches (32*a*, 33*a*) and are fixedly connected to the connection ends (1*a*, 2*a*) of the two handles (1, 2) via the fasteners.

4. The multifunctional muscle exerciser according to claim 3, wherein the handles (1, 2) are made of pipes having inner holes; a spring fixing base (32) is fixed in each of the inner holes of the two handles (1, 2); and the notch (32*a*) is disposed in the spring fixing base (32).

5. The multifunctional muscle exerciser according to claim 1, wherein an end of the spline shaft (33*b*) extends forward to form a section of guide shaft (33*c*); and the diameter of the guide shaft (33*c*) is smaller than that of a tooth root circle of the spline shaft (33*b*).

6. The multifunctional muscle exerciser according to claim 5, wherein at least one annular groove (33*d*) is disposed in the guide shaft (33*c*); a jacking bead (34*b*) is arranged in the connection end (2*a*) of the handle in a radial direction; and when the spline shaft (33*b*) is completely matched with the spline sleeve (34), the jacking bead (34*b*) is matched with the annular groove (33*d*).

7. The multifunctional muscle exerciser according to claim 1, wherein a limiting mechanism is arranged between the two handles (1, 2); the limiting mechanism comprises a protrusion part fixed to the connection end of one handle and a baffle ring fixed on the connection end of the other handle; when the connection ends (1*a*, 2*a*) of the two handles (1, 2) are separated from some distance apart, and the spline shaft (33*b*) is completely separated from the spline sleeve (34), the protrusion part is brought into contact with the baffle ring to prevent the connection ends (1*a*, 2*a*) of the two handles (1, 2) from continuing to separate.

8. The multifunctional muscle exerciser according to claim 1, wherein an angle limiting mechanism is arranged between the two handles (1, 2); the angle limiting mechanism comprises an outer gear ring fixed on the connection end of one handle and an inner gear ring fixed on the connection end of the other handle; convex teeth and tooth grooves matched with each other are arranged between the outer gear ring and the inner gear ring; the convex teeth comprise at least one special convex tooth; the tooth grooves comprise at least one special tooth groove; the special convex tooth can be inserted into other tooth grooves except for the special tooth groove; when an angle between the two handles (1, 2) exceeds a preset value, the special convex tooth is opposite to the special tooth groove in position; and the connection ends (1*a*, 2*a*) of the two handles (1, 2) cannot get close enough, so that the spline shaft (33*b*) cannot be inserted into the spline sleeve (34).

* * * * *